US007765759B2

(12) United States Patent
Au et al.

(10) Patent No.: US 7,765,759 B2
(45) Date of Patent: Aug. 3, 2010

(54) INSULATED CONCRETE FORM

(75) Inventors: Ginawati Au, Aliquippa, PA (US); Shawn P. Jarvie, Monaca, PA (US); Justin D. Rubb, Coraopolis, PA (US); Michael T. Williams, Beaver Falls, PA (US); Daniel Araos, Viera, FL (US); Blain Hileman, New Castle, PA (US)

(73) Assignee: NOVA Chemicals Inc., Moon Township, PA (US)

( * ) Notice: Subject to any disclaimer, the term of this patent is extended or adjusted under 35 U.S.C. 154(b) by 772 days.

(21) Appl. No.: 11/594,592

(22) Filed: Nov. 8, 2006

(65) Prior Publication Data

US 2008/0104912 A1 May 8, 2008

(51) Int. Cl.
*E04B 2/00* (2006.01)
*E04C 1/00* (2006.01)

(52) U.S. Cl. ..... 52/439; 52/309.12; 52/309.17; 52/425; 52/432

(58) Field of Classification Search ..... 52/309.12, 52/309.17, 425, 426, 432, 606, 607, 344
See application file for complete search history.

(56) References Cited

U.S. PATENT DOCUMENTS 3,788,020 A 1/1974 Gregori
4,223,501 A 9/1980 DeLozier
4,229,920 A 10/1980 Lount
4,698,947 A * 10/1987 McKay ..... 52/309.12
4,884,382 A 12/1989 Horobin
4,885,888 A 12/1989 Young
4,889,310 A 12/1989 Boeshart
4,972,646 A 11/1990 Miller et al.
5,014,480 A 5/1991 Guarriello et al.
5,123,222 A 6/1992 Guarriello et al.
5,140,794 A 8/1992 Miller
5,311,718 A 5/1994 Trousilek
5,371,990 A 12/1994 SalahUddin
5,390,459 A 2/1995 Mensen
5,454,199 A 10/1995 Blom et al.
5,459,971 A 10/1995 Sparkman
5,465,542 A * 11/1995 Terry ..... 52/309.7
5,465,545 A 11/1995 Trousilek
5,566,518 A 10/1996 Martin et al.
5,568,710 A 10/1996 Smith et al.
5,570,552 A 11/1996 Nehring
5,625,989 A 5/1997 Brubaker et al.
5,657,600 A 8/1997 Mensen (Continued)

*Primary Examiner*—Brian E Glessner
*Assistant Examiner*—Omar Hijaz
(74) *Attorney, Agent, or Firm*—Gary F. Matz

(57) ABSTRACT

A concrete wall forming system including a plurality of mold units for forming a wall of concrete. The mold units include a bond beam form extending into the body lengthwise, defined by a first wall, a second wall, a bond beam form bottom, a first end and a second end where the first wall and second wall extend a depth defined by a portion of the distance from the top surface to the bottom surface and where the bond beam form does not touch the first side or the second side. First and second ledges extend lengthwise along the body from the first and second sides respectively to the first and second walls respectively of the bond beam form. The bond beam form bottom extends from the first wall to the second wall. At least two column forms extend from the bond beam form bottom to a bottom surface.

17 Claims, 6 Drawing Sheets

U.S. PATENT DOCUMENTS 5,699,640 A 12/1997 Bourgeois et al.
5,701,710 A 12/1997 Tremelling
5,709,060 A 1/1998 Vaughan et al.
5,771,648 A 6/1998 Miller et al.
5,809,727 A 9/1998 Mensen et al.
5,809,728 A 9/1998 Tremelling
5,839,243 A 11/1998 Martin
5,845,449 A 12/1998 Vaughan et al.
5,852,907 A * 12/1998 Tobin et al. ..... 52/714
5,890,337 A 4/1999 Boeshart
5,896,714 A 4/1999 Cymbala et al.
6,167,624 B1 1/2001 Lanahan et al.
6,170,220 B1 1/2001 Moore, Jr.
6,178,711 B1 1/2001 Laird et al.
6,230,462 B1 5/2001 Beliveau
6,240,693 B1 * 6/2001 Komasara et al. ..... 52/439
6,250,024 B1 6/2001 Schulthorpe et al.
6,305,142 B1 * 10/2001 Brisson et al. ..... 52/742.14
6,314,694 B1 11/2001 Cooper et al.
6,314,697 B1 11/2001 Moore, Jr.
6,318,040 B1 11/2001 Moore, Jr.
6,336,301 B1 1/2002 Moore, Jr.
6,378,260 B1 4/2002 Williamson et al.
6,438,918 B2 8/2002 Moore, Jr. et al.
6,481,178 B2 11/2002 Moore, Jr.
6,508,305 B1 1/2003 Brannon et al.
6,530,185 B1 3/2003 Scott et al.
6,592,796 B2 7/2003 Hill et al.
6,647,686 B2 11/2003 Dunn et al.
6,691,485 B1 * 2/2004 Prokofyev ..... 52/604
6,820,384 B1 11/2004 Pfeiffer
6,935,081 B2 8/2005 Dunn et al.
7,032,357 B2 4/2006 Cooper et al.
7,114,296 B2 10/2006 Klassen et al.
2004/0216415 A1 11/2004 Pfeiffer et al.

* cited by examiner

INSULATED CONCRETE FORM

BACKGROUND OF THE INVENTION

1. Field of the Invention

The present invention is directed to a concrete wall forming system and insulated concrete walls formed using the wall forming system.

2. Description of the Prior Art

Concrete walls in building construction are most often produced by first setting up two parallel form walls and pouring concrete into the space between the forms. After the concrete hardens, the builder then removes the forms, leaving the cured concrete wall.

This prior art technique has drawbacks. Formation of the concrete walls is inefficient because of the time required to erect the forms, wait until the concrete cures, and take down the forms. This prior art technique, therefore, is an expensive, labor-intensive process.

Accordingly, techniques have developed for forming modular concrete walls, which use a foam insulating material. The modular form walls are set up parallel to each other and connecting components hold the two form walls in place relative to each other while concrete is poured there between. The form walls, however, remain in place after the concrete cures. That is, the form walls, which are constructed of foam insulating material, are a permanent part of the building after the concrete cures. The concrete walls made using this technique can be stacked on top of each other many stories high to form all of a building's walls. In addition to the efficiency gained by retaining the form walls as part of the permanent structure, the materials of the form walls often provide adequate insulation for the building.

Although the prior art includes many proposed variations to achieve improvements with this technique, drawbacks still exist for each design. The connecting components used in the prior art to hold the walls are constructed of (1) plastic foam, (2) high density plastic, or (3) a metal bridge, which is a non-structural support, i.e., once the concrete cures, the connecting components serve no function. Even so, these members provide thermal and sound insulation functions and have long been accepted by the building industry.

Thus, current insulated concrete form technology requires the use of small molded foam blocks normally 12 to 24 inches in height with a standard length of four feet. The large amount of horizontal and vertical joints that require bracing to correctly position the blocks during a concrete pour, restricts their use to shorter wall lengths and lower wall heights. Wall penetrations such as windows and doors require skillfully prepared and engineered forming to withstand the pressures exerted upon them during concrete placement. Plaster finishing crews have difficulty hanging drywall on such systems due to the problem of locating molded in furring strips. The metal or plastic furring strips in current designs are non-continuous in nature and are normally embedded within the foam faces. The characteristics present in current block forming systems require skilled labor, long lay-out times, engineered blocking and shoring and non-traditional finishing skills. This results in a more expensive wall that is not suitable for larger wall construction applications. The highly skilled labor force that is required to place, block, shore and apply finishes in a block system seriously restricts the use of such systems when compared to traditional concrete construction techniques.

One approach to solving the problem of straight and true walls on larger layouts has been to design larger blocks. Current existing manufacturing technology has limited this increase to 24 inches in height and eight feet in length. Other systems create hot wire cut opposing foamed plastic panels mechanically linked together in a secondary operation utilizing metal or plastic connectors. These panels are normally 48 inches in width and 8 feet in height and do not contain continuous furring strips.

However, none of the approaches described above adequately address the problems of form blowout at higher wall heights due to pressure exerted by the poured concrete, fast and easy construction with an unskilled labor force, and ease of finishing the walls with readily ascertainable attachment points.

Thus there is a need in the art for composite pre-formed building panels and insulated concrete forms with internal blocking and bracing elements that overcome the above-described problems.

SUMMARY OF THE INVENTION

The present invention provides a concrete wall forming system that includes a plurality of interconnected mold units for forming a wall by receiving concrete therein. The mold units include a generally rectangular foamed plastic body having a first side, a second side oppositely opposed to the first side, a first end, a second end oppositely opposed to the first end, a top surface, and a bottom surface oppositely opposed to the top surface. The top surface includes a bond beam form extending into the body lengthwise, defined by a first wall, a second wall, a bond beam form bottom, the first end and the second end where the first wall and second wall extend a depth defined by a portion of the distance from the top surface to the bottom surface and where the bond beam form does not touch the first side or the second side. A first ledge extends lengthwise along the body from the first side to the first wall of the bond beam form and a second ledge extends lengthwise along the body from the second side to the second wall of the bond beam form. The bond beam form bottom extends from the first wall to the second wall of the bond beam form. The body also includes at least two column forms extending from the bond beam form bottom to the bottom surface.

The present invention also provides a wall that includes the above-described concrete wall forming system where concrete has been poured into and set in the bond beam form and column forms in the foamed plastic body.

The present invention additionally provides a method of making the foamed plastic body of the above-described concrete wall forming system that includes:

block molding an expandable plastic;

cutting the column forms using a hot wire by cutting a path into the first side to a depth corresponding to the opening, cutting the opening, and removing the hot wire along the path; and cutting the bond beam form using a hot wire by entering the body where the first ledge and first wall meet and exiting where the second ledge and the second wall meet.

The present invention further provides a foamed plastic body made according to the above-described method.

DETAILED DESCRIPTION OF THE INVENTION

Figure 2:
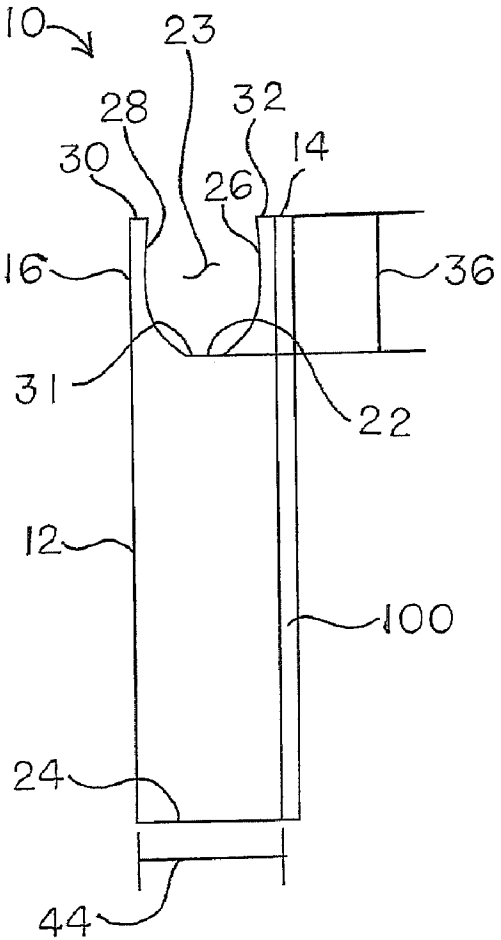
FIG. 2 is an end elevation view of a mold unit according to the invention.
Figure 1:
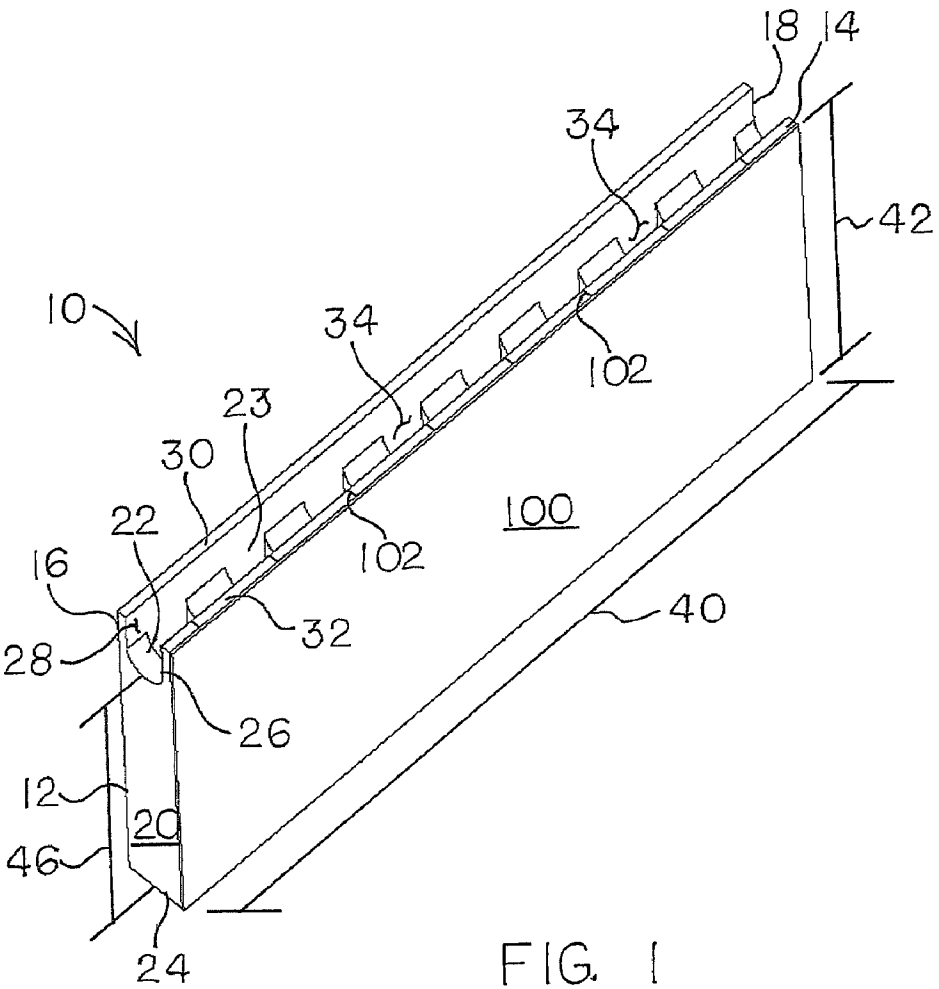
FIG. 1 is a perspective view of a mold unit according to the present invention.
Figure 3:
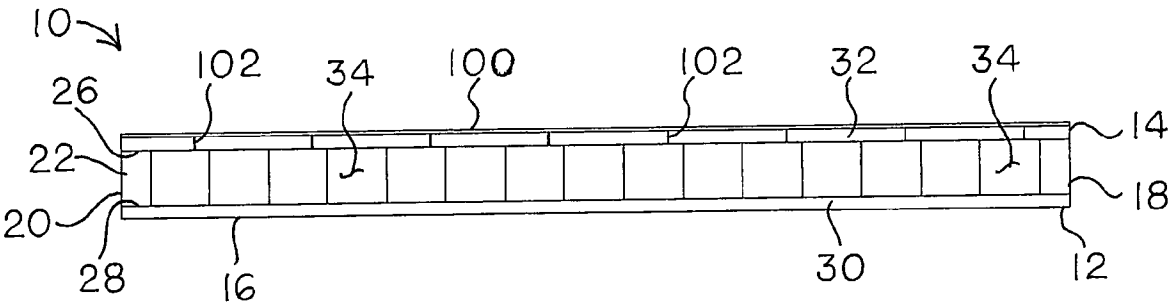
FIG. 3 is a top plan view of a mold unit according to the invention.
Figure 4:
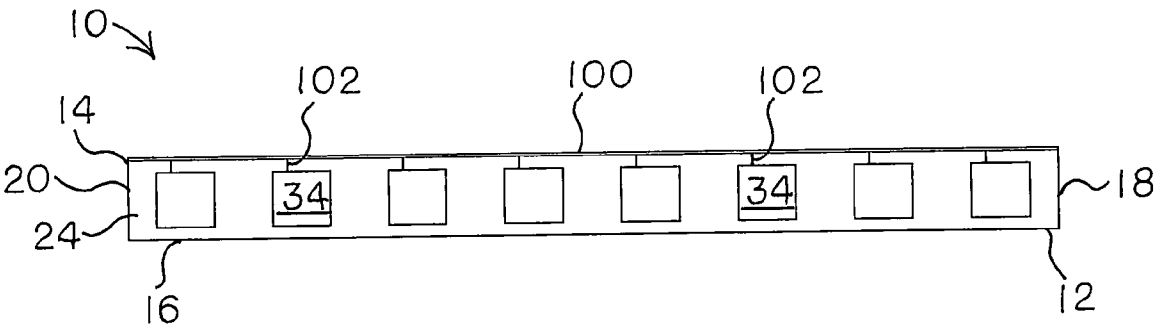
FIG. 4 is a bottom plan view of a mold unit according to the invention.

For the purpose of the description hereinafter, the terms "upper", "lower", "inner", "outer", "right", "left", "vertical", "horizontal", "top", "bottom", and derivatives thereof, shall relate to the invention as oriented in the drawing Figures. However, it is to be understood that the invention may assume alternate variations and step sequences except where expressly specified to the contrary. It is also to be understood that the specific devices and processes, illustrated in the attached drawings and described in the following specification, is an exemplary embodiment of the present invention. Hence, specific dimensions and other physical characteristics related to the embodiment disclosed herein are not to be considered as limiting the invention. In describing the embodiments of the present invention, reference will be made herein to the drawings in which like numerals refer to like features of the invention.

Other than where otherwise indicated, all numbers or expressions referring to quantities, distances, or measurements, etc. used in the specification and claims are to be understood as modified in all instances by the term "about". Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective measurement methods.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used herein, the term "expandable polymer matrix" refers to a polymeric material in particulate or bead form that is impregnated with a blowing agent such that when the particulates and/or beads are placed in a mold and heat is applied thereto, evaporation of the blowing agent (as described below) effects the formation of a cellular structure and/or an expanding cellular structure in the particulates and/or beads and the outer surfaces of the particulates and/or beads fuse together to form a continuous mass of polymeric material conforming to the shape of the mold.

As used herein, the term "polymer" is meant to encompass, without limitation, homopolymers, copolymers and graft copolymers.

As used herein, the terms "(meth)acrylic" and "(meth) acrylate" are meant to include both acrylic and methacrylic acid derivatives, such as the corresponding alkyl esters often referred to as acrylates and (meth)acrylates, which the term "(meth)acrylate" is meant to encompass.

The present invention provides a concrete wall forming system that includes a plurality of inter-connected mold units for forming a wall by receiving concrete therein.

The mold units are made of a foamed plastic that can be produced by expanding an expandable polymer matrix. The expanded polymer matrix is typically molded from expandable thermoplastic particles. These expandable thermoplastic particles are made from any suitable thermoplastic homopolymer or copolymer. Particularly suitable for use are homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl meth-acrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g. polyethylene, polypropylene), polycarbonates, polyphenylene oxides, and mixtures thereof.

In embodiments of the invention, the expandable thermoplastic particles are made by polymerizing a monomer mixture that contains at least 50% by weight of one or more vinyl aromatic monomers. In particular embodiments, divinyl aromatic monomers can be present in the monomer mixture at a level of from at least about 0.01, in some cases at least about 0.02 wt. % and can be present at a level of up to about 0.07, in some cases up to about 0.06, and in other cases up to about 0.05 wt. % based on the weight of the monomer mixture. When the amount of divinyl aromatic monomers is too low, the physical property improvements described below may not be realized. When the amount of divinyl aromatic monomers is too high, the resulting polymer may be difficult or impossible to handle as desired. The amount of divinyl aromatic monomers present in the monomer mixture can be any value or range between any of the values recited above.

The vinyl aromatic monomers can be selected from styrene, isopropylstyrene, alpha-methylstyrene, nuclear methylstyrenes, chlorostyrene, tert-butylstyrene, vinyl toluene, vinyl xylene, ethyl vinyl benzene, vinyl naphthalene, para-methyl styrene, dibromostyrene and combinations thereof.

The divinyl aromatic monomers can be selected from divinyl benzene, divinyl naphthalene, trivinyl benzene, divinyl toluene, divinyl xylene, divinyl alkyl benzenes, divinyl phenanthrene, divinyl biphenyl, divinyl diphenyl methane, divinyl benzyl, divinyl phenyl ether, divinyl diphenyl sulfide; divinyl furan; and combinations thereof. The use of divinyl aromatic monomers is discussed in copending U.S. patent application Ser. No. 11/594,605 entitled "Foamed Plastic Structures," the relevant disclosure of which is herein incorporated by reference.

During the pouring of concrete a hydraulic concrete load acts on the sidewalls of the mold units. This load can cause the sidewalls to deform from their proper vertical, lateral and longitudinal spatial relationships. Also during mold unit transport to a job site, the sidewalls have been known to deform due to the weight of other mold units thereon. The superior physical properties of the present structures, especially when divinyl aromatic monomers are included in the monomer mixture, act to minimize such deformations, a significant improvement over the prior art. Accordingly, problems that have existed when attempting to longitudinally and vertically connect the mold units, such as mating lap joint surfaces and/or tongue/groove elements not being properly aligned are minimized when this exemplary embodiment is employed.

The monomer mixture can be polymerized in any conventional manner. Generally the monomer mixture can be polymerized using a thermal and/or free radical initiation. The process can be a bulk polymerization in which the monomer mixture and, optionally, a minor amount of a diluent such as ethyl benzene, forms the reaction medium. Alternatively, the process can be a suspension or emulsion process in which the monomer mixture is suspended or dispersed in a different, non-hydrocarbon, typically aqueous phase and the polymerization takes place in the dispersed monomer droplets (e.g. suspension) or in a micelle into which monomer diffuses from the monomer droplets (e.g. emulsion).

According to one aspect of the present invention in which the polymer is prepared in a suspension or emulsion, the monomer mixture is suspended in water, from about 50 to 500 parts (in some cases about 75 to 250 parts) by weight, per 100 parts by weight of the monomer mixture using an effective amount of one or more suitable suspending agents. Any of the suspending agents useful in the suspension polymerization of vinyl aromatic polymers can be used. Non-limiting examples of suitable suspending agents include finely divided water-insoluble inorganic substances such as tricalcium phosphate and the like as well as water-soluble polymers such as polyvinyl alcohol, alkyl aryl sulfonates, hydroxyethyl cellulose, polyacrylic acid, methyl cellulose, polyvinyl pyrrolidone, and low molecular weight (often Mw less than about 5,000) polyalkylene glycols (e.g. polyethylene glycols and polypropylene glycols) and the like. Auxiliary suspending agents such as sodium linear alkylbenzene sulfonates can also be employed. The use of tricalcium phosphate together with a sodium linear alkylbenzene sulfonate is particularly useful. The amount of the suspending agent necessary will vary depending on a number of factors but will generally be from about 0.01 to 1 part by weight per 100 parts by weight of the monomer mixture. One or more surfactants such as a polyoxyalkylene derivative of sorbitan monolaurate or other fatty acid ester, an ethylene oxide/propylene oxide block copolymer, or other non-ionic or anionic surface active agent can be added to the aqueous suspension if desired. In embodiments of the invention, the amount of surfactant is from about 0.01 to 1 part by weight per 100 parts by weight of monomer.

In addition to the monomers, the aqueous suspension can include a free radical initiator or free radical initiator system. The free radical generator can be a peroxide such as hydrogen peroxide or benzoyl peroxide, or a persulfate initiator.

The reaction mixture is heated to initiate polymerization, either thermally or by a free radical catalyst. After the monomers are polymerized to form particles or beads (generally resulting from the suspension process) or microparticles (generally resulting from the emulsion process), they can be separated from the aqueous phase and washed.

In a particular embodiment of the invention, the expandable thermoplastic particles are expandable polystyrene (EPS) particles. These particles can be in the form of beads, granules, or other particles convenient for the expansion and molding operations. Particles polymerized in an aqueous suspension process are essentially spherical and are useful for molding the expanded polymer body, panels and/or forms described herein below. These particles can be screened so that their size ranges from about 0.008 inches (0.2 mm) to about 0.16 inches (4 mm).

In an embodiment of the invention, resin beads (unexpanded) containing any of the polymers or polymer compositions described herein have a particle size of at least 0.2, in some situations at least 0.33, in some cases at least 0.35, in other cases at least 0.4, in some instances at least 0.45 and in other instances at least 0.5 mm. Also, the resin beads can have a particle size of up to about 4, in some situations up to about 3.5, in other situations up to about 3, in some instances up to 2, in other instances up to 2.5, in some cases up to 2.25, in other cases up to 2, in some situations up to 1.5 and in other situations up to 1 mm. The resin beads used in this embodiment can be any value or can range between any of the values recited above.

The average particle size and size distribution of the expandable resin beads or pre-expanded resin beads can be determined using low angle light scattering, which can provide a weight average value. As a non-limiting example, a Model LA-910 Laser Diffraction Particle Size Analyzer available from Horiba Ltd., Kyoto, Japan can be used As used herein, the terms "expandable thermoplastic particles" or "expandable resin beads" refers to a polymeric material in particulate or bead form that is impregnated with a blowing agent such that when the particulates and/or beads are placed in a mold or expansion device and heat is applied thereto, evaporation of the blowing agent (as described below) effects the formation of a cellular structure and/or an expanding cellular structure in the particulates and/or beads. When expanded in a mold, the outer surfaces of the particulates and/or beads fuse together to form a continuous mass of polymeric material conforming to the shape of the mold.

As used herein, the terms "pre-expanded thermoplastic particles", "pre-expanded resin beads", or "pre-puff" refers to expandable resin beads that have been expanded, but not to their maximum expansion factor and whose outer surfaces have not fused. As used herein, the term "expansion factor" refers to the volume a given weight of resin bead occupies, typically expressed as cc/g. Pre-expanded resin beads can be further expanded in a mold where the outer surfaces of the pre-expanded resin beads fuse together to form a continuous mass of polymeric material conforming to the shape of the mold.

The expandable thermoplastic particles can be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g. CFC's and HCFC's, which boil at a temperature below the softening point of the polymer chosen. Mixtures of these aliphatic hydrocarbon blowing agents can also be used.

Alternatively, water can be blended with these aliphatic hydrocarbons blowing agents or water can be used as the sole blowing agent as taught in U.S. Pat. Nos. 6,127,439; 6,160,027; and 6,242,540 in these patents, water-retaining agents are used. The weight percentage of water for use as the blowing agent can range from 1 to 20%. The texts of U.S. Pat. Nos. 6,127,439, 6,160,027 and 6,242,540 are incorporated herein by reference.

The impregnated thermoplastic particles are generally pre-expanded to a density of at least 0.1 lb/ft$^3$, in some cases at least 0.25 lb/ft$^3$, in other cases at least 0.5 lb/ft$^3$, in some situations at least 0.75 lb/ft$^3$, in other situations at least 1 lb/ft$^3$, and in some instances at least about 2 lb/ft$^3$. Also, the density of the impregnated pre-expanded particles can be up to 12 lb/ft$^3$, in some cases up to 10 lb/ft$^3$, and in other cases up to 5 lb/ft$^3$. The density of the impregnated pre-expanded particles can be any value or range between any of the values recited above. The pre-expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated thermoplastic particles can be foamed cellular polymer particles as taught in U.S. Patent Application Publication No. 2002/0117769, the teachings of which are incorporated herein by reference. The foamed cellular particles can be polystyrene that are pre-expanded and contain a volatile blowing agent at a level of less than 14 wt %, in some situations less than 8 wt %, in some cases ranging from about 2 wt % to about 7 wt %, and in other cases ranging from about 2.5 wt % to about 6.5 wt % based on the weight of the polymer.

An interpolymer of a polyolefin and in situ polymerized vinyl aromatic monomers that can be included in the expandable thermoplastic resin according to the invention is disclosed in U.S. Pat. Nos. 4,303,756, 4,303,757 and 6,908,949, the relevant portions of which are herein incorporated by reference. A non-limiting example of interpolymers that can be used in the present invention include those available under the trade name ARCEL®, available from NOVA Chemicals Inc., Pittsburgh, Pa. and PIOCELAN®, available from Sekisui Plastics Co., Ltd., Tokyo, Japan.

The expanded polymer matrix can include customary ingredients and additives, such as pigments, dyes, colorants, plasticizers, mold release agents, stabilizers, ultraviolet light absorbers, mold prevention agents, antioxidants, flame retardants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In a particular embodiment of the invention the pigment is carbon black, a non-limiting example of such a material being EPS SILVER®, available from NOVA Chemicals Inc.

In another particular embodiment of the invention the pigment is graphite, a non-limiting example of such a material being NEOPOR®, available from BASF Aktiengesellschaft Corp., Ludwigshafen am Rhein, Germany.

Non-limiting examples of suitable flame retardants that can be used in the invention include phosphoric esters, such as triphenyl phosphate; bromine compounds, such as decabromobiphenyl, pentabromotoluene, brominated epoxy resin, hexabromocyclododecane, penta-bromophenyl allyl ether, tris dibromo-propylphosphate, bis allyl ether of tetrabromo-bis-phenol A, octabromo-diphenyl oxide, decabromodiphenyl oxide, halogenated hydrocarbyl phosphate or phosphonate esters and tris-dibromopropyl antimonite; chlorine compounds such as chloroparaffins, mixed halogen compounds such as penta-bromo monochloro cyclohexane; nitrogen-containing phosphorus compounds such as melamine derivatives; alumina trihydrates hydroxylamine esters; antimony compounds such as antimony trioxide; boron compounds; and zinc compounds. When used, the flame retardants are present at from about 0.6 to about 7% by weight based on the weight of the expandable polymer matrix.

The pre-expanded particles or "pre-puff" are heated in a closed mold in block molding operations and subsequently cut, as a non-limiting example, by using a hot wire as described below to form the mold units.

In another embodiment of the invention, the mold units can have a male "tongue" edge and a female "groove" edge that facilitates a "tongue and groove" union of two matching mold units. In other embodiments of the invention, the mold units can have overlapping lip ends adapted to join matching mold units together.

In embodiments of the invention shown in FIGS. 1-4 mold units 10 according to the invention include a generally rectangular foamed plastic body 12 that includes first side 14, second side 16 oppositely opposed to first side 14, first end 18, second end 20 oppositely opposed to first end 18, top surface 22, and bottom surface 24 oppositely opposed to top surface 22. Top surface 22 includes bond beam form 23 extending into body 12 lengthwise, defined by first wall 26, second wall 28, bond beam form bottom 31, first end 18 and second end 20 where first wall 26 and second wall 28 extend a depth 36 defined by a portion of the distance from top surface 22 to bottom surface 24 and where bond beam form 23 does not touch first side 14 or second side 16. First ledge 30 extends lengthwise along body 12 from first side 14 to first wall 26 of bond beam form 23 and second ledge 32 extends lengthwise along body 12 from second side 16 to second wall 28 of bond beam form 23. Bond beam form bottom 31 extends from first wall 26 to second wall 28 of bond beam form 23. Body 12 also includes at least two column forms 34 extending from bond beam form bottom 31 to bottom surface 24.

Mold units 10 can have a horizontal length 40 of at least about 3, in some cases at least about 4, in other cases at least about 6, in some instances at least about 8, in other instances at least about 10, and in some situations at least about 12 feet and can be up to about 30, in some cases about up to 25 and in other cases up to 20 feet. Length 40 is determined by the intended overall insulated concrete wall design while minimizing the number of seams between mold units 10. Length 40 can be any value or range between any of the values recited above.

Mold units 10 can have a vertical height 42 of from about 3, in some cases at least about 4, in other cases at least about 6, in some instances at least about 8, in other instances at least about 10, and in some situations at least about 12 feet and can be up to about 20, in some cases about up to 18, and in other cases up to 16 feet. Height 42 is determined by the intended number of courses of mold units 10 to be used in an overall insulated concrete wall design. Height 42 can be any value or range between any of the values recited above.

Mold units 10 can have a width 44 of from about 4, in some cases at least about 5, in other cases at least about 6 inches and can be up to about 30, in some cases up to about 24, and in other cases up to about 16 inches. Width 44 is determined by the design for an overall insulated concrete wall. Width 44 can be any value or range between any of the values recited above.

Bond beam form 23 can have any suitable cross sectional shape, non-limiting examples including U-shaped, trapezoidal and rectangular cross-sectional shape.

Depth 36 can be at least 2, in some cases a least 3 and in other cases at least 4 inches and can be up to 24, in some cases up to 20, and in other cases up to 16 inches. Depth 36 is determined based on the overall dimensions of mold unit 10 and the intended load bearing properties of any insulated concrete wall expected to result from using mold unit 10.

Length 46 of column forms 34 is typically the height 42 of mold units 10 less the Depth 36 of bond beam form 23. Thus length 46 can be at least about 34, in some cases at least about 46, in other cases at least about 70, in some instances at least about 94, in other instances at least about 118, and in some situations at least about 142 inches and can be up to about 238, in some cases about up to 214, and in other cases up to 190 inches. Length 46 is determined by the design of the intended insulated concrete wall. Length 46 can be any value or range between any of the values recited above.

Column forms 34 can have any suitable cross-sectional shape, non-limiting examples including round, oval, elliptical, square, rectangular, triangular, hexagonal and octagonal. It should be noted that regardless of the cross-sectional shape of column forms 34, no portion of column forms 34 contact first side 14, second side 16, first end 18 or second end 20.

The cross-sectional area of column forms 34 is determined based on the load bearing design of the resulting insulated concrete wall. The cross-sectional area of column forms 34 can be at least about 8 $in^2$ (52 $cm^2$), in some cases at least about 12 $in^2$ (77 $cm^2$), and in other cases at least about 16 $in^2$ (103 $cm^2$) and can be up to about 36 $in^2$ (232 $cm^2$), in some cases up to about 30 $in^2$ (194 $cm^2$) and in other cases up to about 25 $in^2$ (161 $cm^2$). The cross-sectional area of column forms 34 can independently be any value or range between any of the values recited above.

In embodiments of the invention, the mold units can be made by first block molding an expandable polymer matrix; cutting the column forms using a hot wire by cutting a path into the first side to a depth corresponding to the opening, cutting the opening, and removing the hot wire along the path; and cutting the bond beam form using a hot wire by entering the body where the first ledge and first wall meet and exiting where the second ledge and the second wall meet. As indicated above, the expandable polymer matrix can contain one or more flame retardants.

In many embodiments of the invention, a finish surface is attached to either or both of the first side and/or the second side of the present mold units. In particular embodiments of the invention, the finish surface is attached to the side of the mold unite where the hot wire entered the mold unit to cut the column forms. Referring to FIGS. 1-4, the mold units according to the invention can include finish surface 100 and column form cuts 102.

Any suitable finish surface can be used with the present mold units. Suitable finish surface include, but are not limited to wood, rigid plastics, wood paneling, concrete panels, cement panels, drywall, sheetrock, particle board, rigid plastic panels, a metal lath, and combinations thereof. In some embodiments of the invention, the attachment of the finish surface acts to seal and strengthen the present mold units, especially in reinforcing the area around column cuts 102.

Any suitable adhesive or binding substance known to those skilled in the construction arts can be used in the invention. Suitable adhesives and binding substances include, but are not limited to ethylene-vinyl acetate resins, polyolefin resins, polyester resins, polyester-amide resins, polyamide resins, thermoplastic elastomers, acrylic resins, cellulosic resins, styrene-rubber copolymers and combinations thereof. Particular examples include BYNEL® ethylene vinyl acetate available from E. I. du Pont de Nemours and Company, Wilmington, Del., PLEXAR® ethylene vinyl acetate available from Equistar Chemicals, Houston, Tex., KRATON® block copolymers that include polymeric regions of styrene-rubber-styrene available from Kraton Polymers U.S. LLC, Houston, Tex.

As indicated above, the present mold units can be arrayed end to end to form a larger wall forming system. Thus a plurality of rectangular units and optionally a plurality of corner units can be arranged sequentially from a first unit to a last unit. In some embodiments, the first end of the first unit is in contact with the second end of the last unit.

Figure 8:
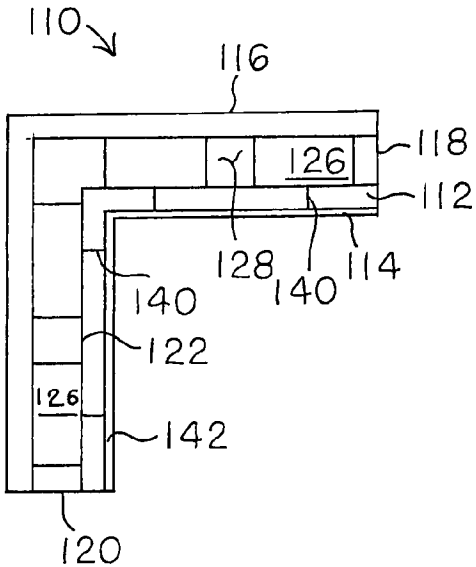
FIG. 8 is a bottom plan view of a corner mold unit according to the invention.
Figure 7:
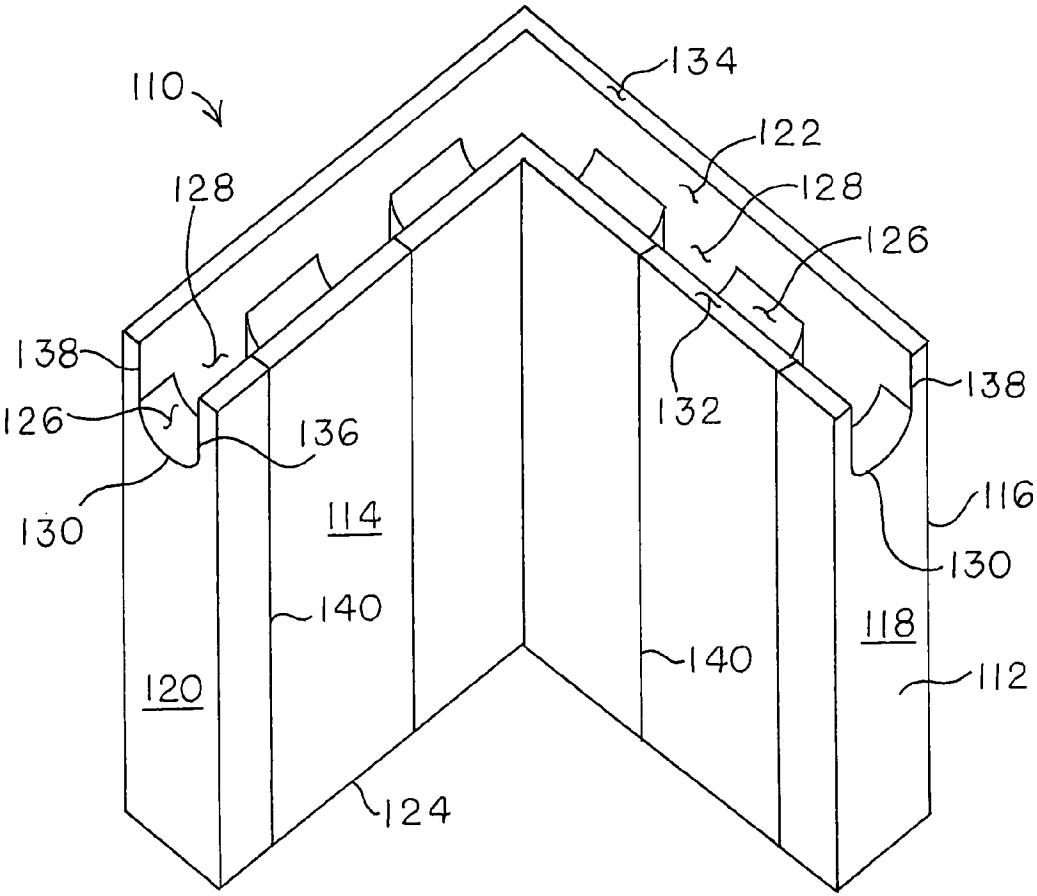
FIG. 7 is a top perspective view of a corner mold unit according to the invention.

Exemplary corner units that can be used in the invention are shown in FIGS. 7 and 8. The corner units can be right facing or left facing, which is a mirror image of a right facing corner unit. Referring to FIGS. 7 and 8, corner unit 110 includes a foamed plastic body 112 having a first corner side 114, a second corner side 116 oppositely opposed to first corner side 114, a first corner end 118, a second corner end 120, a top corner surface 122, a bottom corner surface 124 oppositely opposed to top corner surface 122, and at least two corner column forms 126.

Top corner surface 122 includes a corner beam form 128 that extends into body 112 and is defined by first wall 136, second wall 138, corner beam form bottom 130, first ledge 132 and second ledge 134 where walls 136 and 138 extend a depth as described above for depth 36. Corner beam form 128 does not touch first side 114 or second side 116. First ledge 132 extends along body 112 from first side 114 to first wall 136 of corner beam form 128 and second ledge 134 extends lengthwise along body 112 from second side 116 to second wall 138 of corner beam form 128. Corner beam form bottom 130 extends from first wall 136 to second wall 138 of corner beam form 128. Body 112 also includes at least two column forms 126 extending from beam form bottom 130 to bottom surface 124.

Corner mold units 110 are made as described above and include corner column cuts 140. Corner finish surfaces 142, which can be any suitable finish surface described above can also be included in Corner mold units 110.

Figure 9:
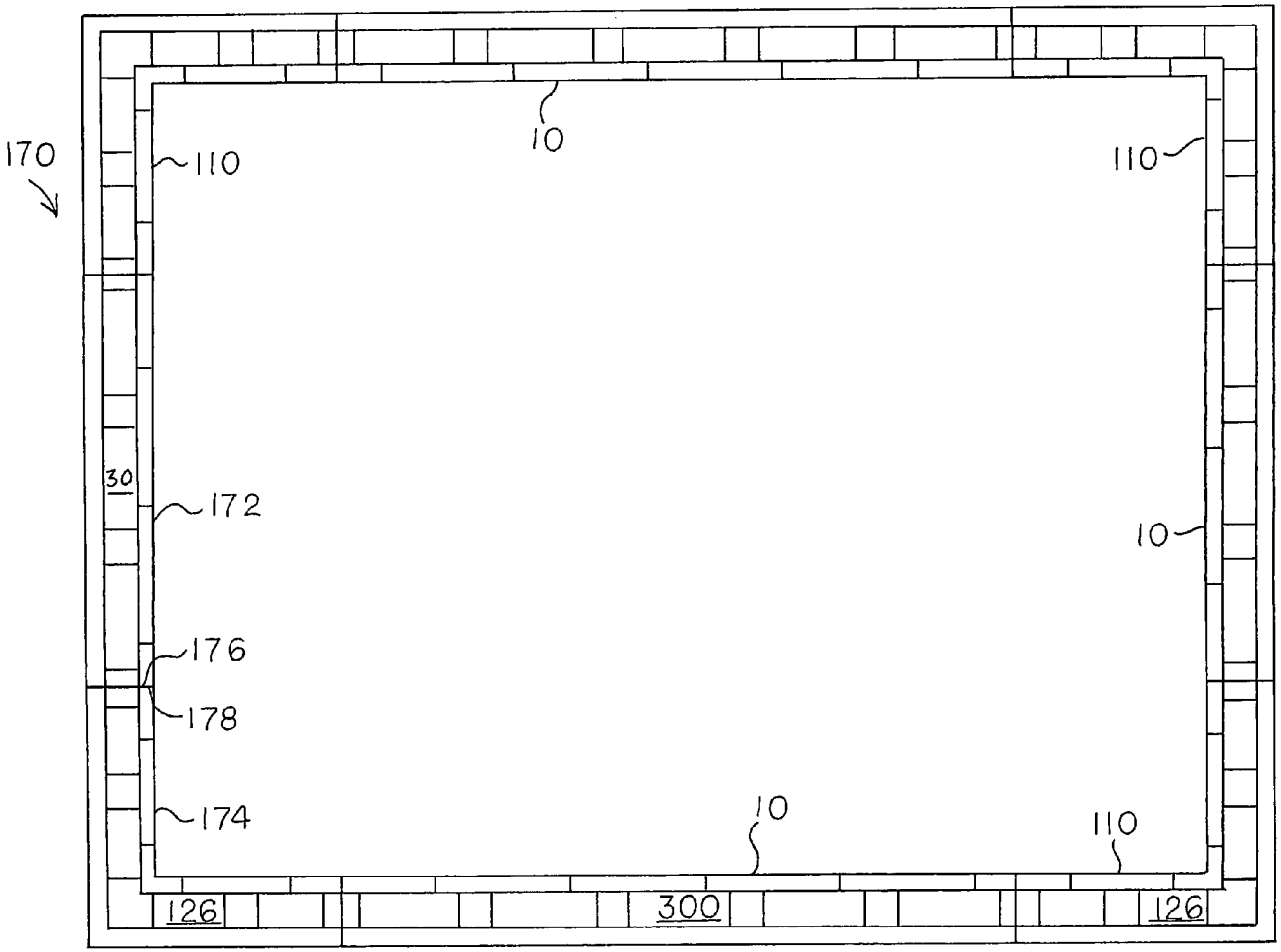
FIG. 9 is a top plan view of linked linear and corner mold units according to the invention.

Mold units 10 and corner units 110 can be arranged sequentially from a continuous concrete wall forming system. As a non-limiting example shown in FIG. 9, continuous wall forming system 170 includes first unit 172 and last corner unit 174 such that the first end 176 of first unit 172 is in contact with the second end 178 of last corner unit 174 to form continuous wall mold system 170. As shown, wall mold system 170 includes a plurality of linear mold units 10 and corner mold units 110 that contain a plurality of evenly spaced column forms 30 and 126.

Figure 5:
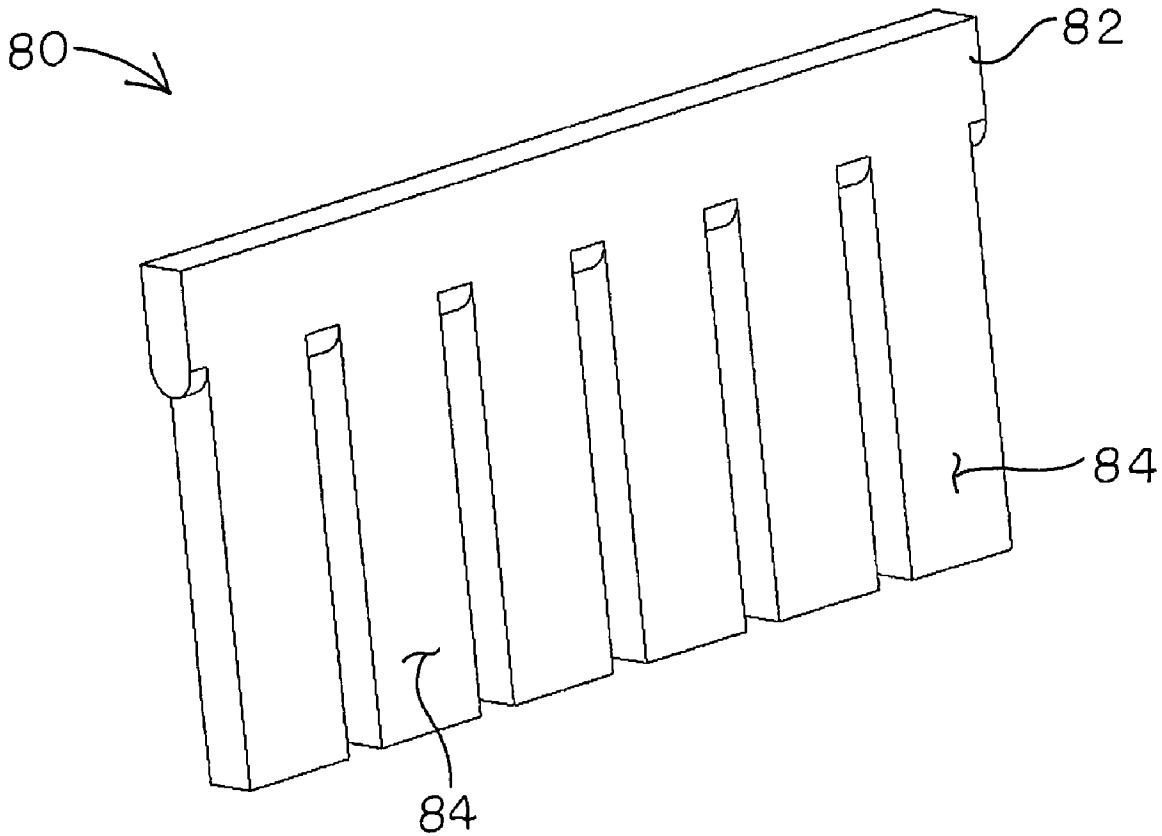
FIG. 5 is a perspective view of a concrete web formed in the mold unit of FIGS. 1-4 according to the invention.

Insulated concrete walls according to the invention are formed by pouring concrete into mold unit 10 and allowing the concrete to set and harden to form a concrete web structure. In many embodiments of the invention, as shown in FIG. 5, concrete web 80, includes a concrete beam 82 and a plurality of concrete columns 84. The dimensions of beam 82 and columns 84 are determined by the respective corresponding dimensions of bond beam form 23 and column forms 34 as described above.

As such, the present invention provides a wall that includes one or more rows of the concrete wall forming systems as described above where concrete is poured into and set in the bond beam forms and column forms in the mold units.

Further, the present insulated concrete wall can be a continuous structure, as those skilled in the art will readily appreciate, that is formed by pouring concrete into continuous wall forming system 170 and allowing it to set and harden forming a continuous concrete web as described above.

Embodiments of the invention provide a continuous wall that includes the above-described concrete wall forming system, where concrete is poured into and set in the bond beam forms and column forms in the mold units.

Often, in order to add strength to an insulated concrete wall system, concrete reinforcing products are placed within the bond beam forms and/or column forms described above.

In embodiments of the invention, the concrete reinforcing product can be selected from rebar, fiber reinforced polymer, carbon fibers, aramid fibers, glass fibers, metal fibers and combinations thereof.

As used herein, the term "fiber reinforced polymer" refers to plastics that include, but are not limited to reinforced thermoplastics and reinforced thermoset resins. Thermoplastics include polymers and polymers made up of materials that can be repeatedly softened by heating and hardened again on cooling. Suitable thermoplastic polymers include, but are not limited to homopolymers and copolymers of styrene, homopolymers and copolymers of $C_2$ to $C_{20}$ olefins, $C_4$ to $C_{20}$ dienes, polyesters, polyamides, homopolymers and copolymers of $C_2$ to $C_{20}$ (meth)acrylate esters, polyetherimides, polycarbonates, polyphenylethers, polyvinylchlorides, polyurethanes, and combinations thereof.

Suitable thermoset resins are resins that when heated to their cure point, undergo a chemical cross-linking reaction causing them to solidify and hold their shape rigidly, even at elevated temperatures. Suitable thermoset resins include, but are not limited to alkyd resins, epoxy resins, diallyl phthalate resins, melamine resins, phenolic resins, polyester resins, urethane resins, and urea, which can be crosslinked by reaction, as non-limiting examples, with diols, triols, polyols, and/or formaldehyde.

Fiber reinforcing materials that can be incorporated into the thermoplastics and/or thermoset resins include, but are not limited to carbon fibers, aramid fibers, glass fibers, metal fibers, woven fabric or structures of the mentioned fibers, and/or fiberglass, and can optionally include one or more fillers, non-limiting examples including carbon black, graphite, clays, calcium carbonate, titanium dioxide, and combinations thereof.

Figure 6:
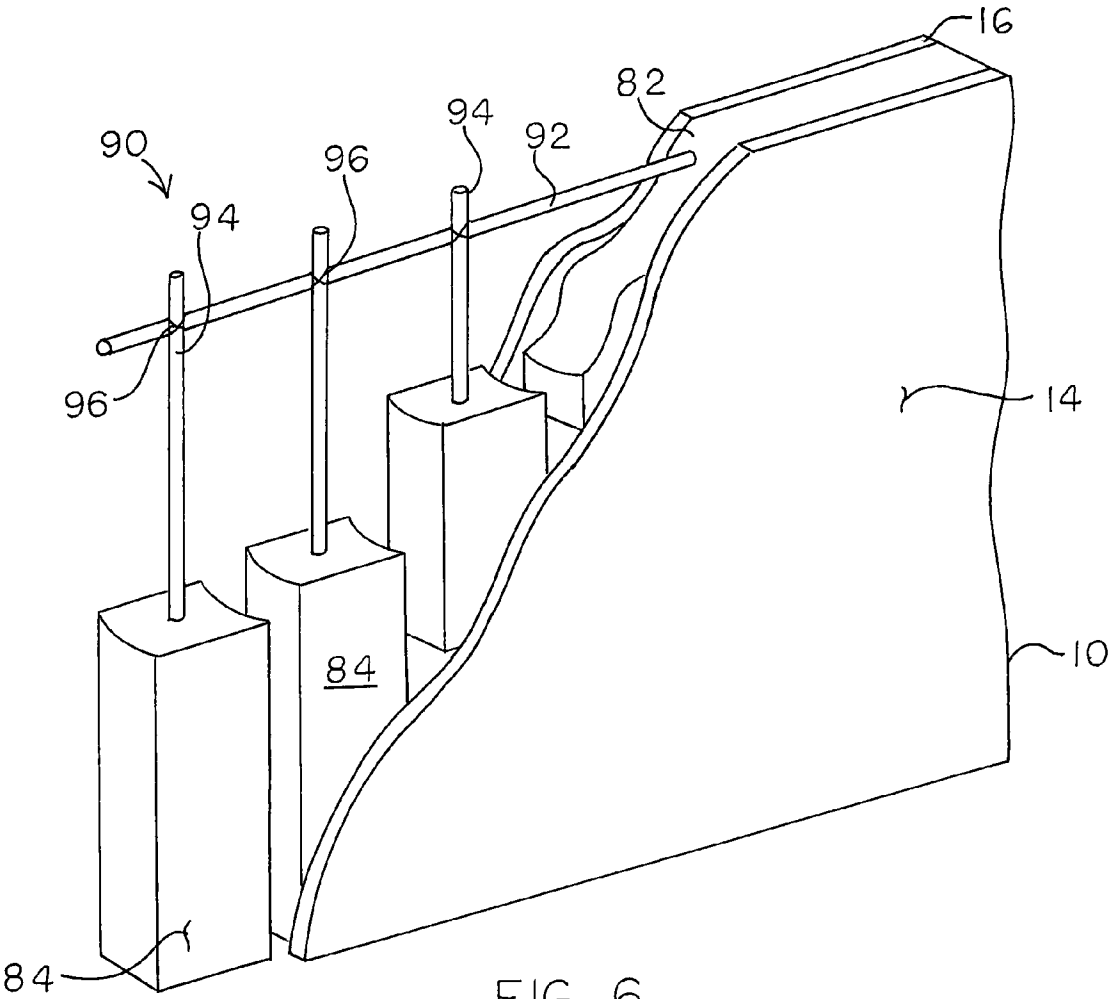
FIG. 6 is a cut away perspective view of an insulated reinforced concrete wall according to the invention.

In an embodiment of the invention shown in FIG. 6, rebar can be added to the concrete wall and wall forming system. As such, reinforced insulated concrete wall 90 includes horizontal rebar 92, which can be placed in bond beam form 23 and vertical rebar 94, which can be placed in column forms 34. At intersection 96, where horizontal rebar 92 and vertical rebar 94 intersect, the rebar can be secured into position using appropriate ties, rope, wire, etc. as is known in the art. In many embodiments of the invention, horizontal rebar 92 is placed at approximately the center of the cross-section of bond beam form 23 and vertical rebar 94 is placed at approximately the center of the cross-section of column forms 34.

Further, in many embodiments of the invention, horizontal rebar 92 is located at approximately the center of the cross-section of concrete beam 82 and vertical rebar 94 is located at approximately the center of the cross-section of concrete columns 84.

Any suitable type of concrete can be used to make the concrete walls and concrete wall systems described herein. The specific type of concrete will depend on the desired and designed properties of the concrete walls and concrete wall systems. In embodiments of the invention, the concrete includes one or more hydraulic cement compositions selected from Portland cements, pozzolana cements, gypsum cements, aluminous cements, magnesia cements, silica cements, and slag cements.

In an embodiment of the invention, the concrete includes a hydraulic cement composition. The hydraulic cement composition can be present at a level of at least 3, in certain situations at least 5, in some cases at least 7.5, and in other cases at least 9 volume percent and can be present at levels up to 40, in some cases up to 35, in other cases up to 32.5, and in some instances up to 30 volume percent of the cement mixture. The concrete can include the hydraulic cement composition at any of the above-stated levels or at levels ranging between any of levels stated above.

In an embodiment of the invention, the concrete mixture can optionally include other aggregates and adjuvants known in the art including but not limited to sand, additional aggregate, plasticizers and/or fibers. Suitable fibers include, but are not limited to glass fibers, silicon carbide, aramid fibers, polyester, carbon fibers, composite fibers, fiberglass, metal and combinations thereof as well as fabric containing the above-mentioned fibers, and fabric containing combinations of the above-mentioned fibers.

Non-limiting examples of fibers that can be used in the invention include MeC-GRID® and C-GRID® available from TechFab, LLC, Anderson, S.C., KEVLAR® available from E.I. du Pont de Nemours and Company, Wilmington Del., TWARON® available from Teijin Twaron B.V., Arnheim, the Netherlands, SPECTRA® available from Honeywell International Inc., Morristown, N.J., DACRON® available from Invista North America S.A.R.L. Corp. Wilmington, Del., and VECTRAN® available from Hoechst Celanese Corp., New York, N.Y. The fibers can be used in a mesh structure, intertwined, interwoven, and oriented in any desirable direction.

In a particular embodiment of the invention fibers can make up at least 0.1, in some cases at least 0.5, in other cases at least 1, and in some instances at least 2 volume percent of the concrete composition. Further, fibers can provide up to 10, in some cases up to 8, in other cases up to 7, and in some instances up to 5 volume percent of the concrete composition. The amount of fibers is adjusted to provide desired properties to the concrete composition. The amount of fibers can be any value or range between any of the values recited above.

Further to this embodiment, the additional aggregate can include, but is not limited to, one or more materials selected from common aggregates such as sand, stone, and gravel. Common lightweight aggregates can include ground granulated blast furnace slag, fly ash, glass, silica, expanded slate and clay; insulating aggregates such as pumice, perlite, vermiculite, scoria, and diatomite; light-weight aggregate such as expanded shale, expanded slate, expanded clay, expanded slag, fumed silica, pelletized aggregate, extruded fly ash, tuff, and macrolite; and masonry aggregate such as expanded shale, clay, slate, expanded blast furnace slag, sintered fly ash, coal cinders, pumice, scoria, and pelletized aggregate.

When included, the other aggregates and adjuvants are present in the concrete mixture at a level of at least 0.5, in some cases at least 1, in other cases at least 2.5, in some instances at least 5 and in other instances at least 10 volume percent of the concrete mixture. Also, the other aggregates and adjuvants can be present at a level of up to 95, in some cases up to 90, in other cases up to 85, in some instances up to 65 and in other instances up to 60 volume percent of the concrete mixture. The other aggregates and adjuvants can be present in the concrete mixture at any of the levels indicated above or can range between any of the levels indicated above.

In embodiments of the invention, the concrete compositions can contain one or more additives, non-limiting examples of such being anti-foam agents, water-proofing agents, dispersing agents, set-accelerators, set-retarders, plasticizing agents, superplasticizing agents, freezing point decreasing agents, adhesiveness-improving agents, and colorants. The additives are typically present at less than one percent by weight with respect to total weight of the composition, but can be present at from 0.1 to 3 weight percent.

Suitable dispersing agents or plasticizers that can be used in the invention include, but are not limited to hexametaphosphate, tripolyphosphate, polynaphthalene sulphonate, sulphonated polyamine and combinations thereof.

Suitable plasticizing agents that can be used in the invention include, but are not limited to polyhydroxycarboxylic acids or salts thereof, polycarboxylates or salts thereof; lignosulfonates, polyethylene glycols, and combinations thereof.

Suitable superplasticizing agents that can be used in the invention include, but are not limited to alkaline or earth alkaline metal salts of lignin sulfonates; lignosulfonates, alkaline or earth alkaline metal salts of highly condensed naphthalene sulfonic acid/formaldehyde condensates; polynaphthalene sulfonates, alkaline or earth alkaline metal salts of one or more polycarboxylates (such as poly(meth)-acrylates and the polycarboxylate comb copolymers described in U.S. Pat. No. 6,800,129, the relevant portions of which are herein incorporated by reference); alkaline or earth alkaline metal salts of melamine/formaldehyde/sulfite condensates; sulfonic acid esters; carbohydrate esters; and combinations thereof.

Suitable set-accelerators that can be used in the invention include, but are not limited to soluble chloride salts (such as calcium chloride), triethanol-amine, paraformaldehyde, soluble formate salts (such as calcium formate), sodium hydroxide, potassium hydroxide, sodium carbonate, sodium sulfate, $12CaO.7Al_2O_3$, sodium sulfate, aluminum sulfate, iron sulfate, the alkali metal nitrate/sulfonated aromatic hydrocarbon aliphatic aldehyde condensates disclosed in U.S. Pat. No. 4,026,723, the water soluble surfactant accelerators disclosed in U.S. Pat. No. 4,298,394, the methylol derivatives of amino acids accelerators disclosed in U.S. Pat. No. 5,211,751, and the mixtures of thiocyanic acid salts, alkanolamines, and nitric acid salts disclosed in U.S. Pat. No. Re. 35,194, the relevant portions of which are herein incorporated by reference, and combinations thereof.

Suitable set-retarders that can be used in the invention include, but are not limited to lignosul-fonates, hydroxycarboxylic acids (such as gluconic acid, citric acid, tartaric acid, maleic acid, salicylic acid, glucoheptonic acid, arabonic acid, acid, and inorganic or organic salts thereof such as sodium, potassium, calcium, magnesium, ammonium and triethanolamine salt), cardonic acid, sugars, modified sugars, phosphates, borates, silico-fluorides, calcium bromate, calcium sulfate, sodium sulfate, monosac-charides such as glucose, fructose, galactose, saccharose, xylose, apiose, ribose and invert sugar, oligosaccharides such as disaccharides and trisac-charides, such oligosaccharides as dextrin, polysaccharides such as dextran, and other saccharides such as molasses containing these; sugar alcohols such as sorbitol; magnesium silicofluoride; phosphoric acid and salts thereof, or borate esters; aminocarboxylic acids and salts thereof; alkali-soluble proteins; humic acid; tannic acid; phenols; polyhydric alcohols such as glycerol; phosphonic acids and derivatives thereof, such as aminotri(methylenephosphonic acid), 1-hydroxy-ethylidene-1,1-diphosphonic acid, ethylenediaminetetra-(methylenephosphonic acid), diethylenetriaminepenta-(methylenephosphonic acid), and alkali metal or alkaline earth metal salts thereof, and combinations of the set-retarders indicated above.

Suitable defoaming agents that can be used in the invention include, but are not limited to silicone-based defoaming agents (such as dimethylpolysiloxane, dimethylsilicone oil, silicone paste, silicone emulsions, organic group-modified polysiloxanes (polyorganosiloxanes such as dimethylpolysiloxane), fluorosilicone oils, etc.), alkyl phosphates (such as tributyl phosphate, sodium octylphosphate, etc.), mineral oil-based defoaming agents (such as kerosene, liquid paraffin, etc.), fat- or oil-based defoaming agents (such as animal or vegetable oils, sesame oil, castor oil, alkylene oxide adducts derived there from, etc.), fatty acid-based defoaming agents (such as oleic acid, stearic acid, and alkylene oxide adducts derived there from, etc.), fatty acid ester-based defoaming agents (such as glycerol monoricinolate, alkenyl-succinic acid derivatives, sorbitol monolaurate, sorbitol trioleate, natural waxes, etc.), oxyalkylene type defoaming agents, alcohol-based defoaming agents: octyl alcohol, hexadecyl alcohol, acetylene alcohols, glycols, etc.), amide-based defoaming agents (such as acrylate polyamines, etc.), metal salt-based defoaming agents (such as aluminum stearate, calcium oleate, etc.) and combinations of the above-described defoaming agents.

Suitable freezing point decreasing agents that can be used in the invention include, but are not limited to ethyl alcohol, calcium chloride, potassium chloride, and combinations thereof.

Suitable adhesiveness-improving agents that can be used in the invention include, but are not limited to polyvinyl acetate, styrene-butadiene, homopolymers and copolymers of (meth) acrylate esters, and combinations thereof.

Suitable water-repellent or water-proofing agents that can be used in the invention include, but are not limited to fatty acids (such as stearic acid or oleic acid), lower alkyl fatty acid esters (such as butyl stearate), fatty acid salts (such as calcium or aluminum stearate), silicones, wax emulsions, hydro-carbon resins, bitumen, fats and oils, silicones, paraffins, asphalt, waxes, and combinations thereof. Although not used in many embodiments of the invention, when used suitable air-entraining agents include, but are not limited to vinsol resins, sodium abietate, fatty acids and salts thereof, tensides, alkyl-aryl-sulfonates, phenol ethoxylates, lignosulfonates, and mixtures thereof.

In some embodiments of the invention, the concrete is light-weight concrete. As used herein, the term "light weight concrete" refers to concrete where light-weight aggregate is included in a cementitous mixture. Exemplary light weight concrete compositions that can be used in the present invention are disclosed in U.S. Pat. Nos. 3,021,291, 3,214,393, 3,257,338, 3,272,765, 5,622,556, 5,725,652, 5,580,378, and 6,851,235, JP 9 071 449, WO 98 02 397, WO 00/61519, and WO 01/66485 the relevant portions of which are incorporated herein by reference.

In particular embodiments of the present invention, the lightweight concrete (LWC) composition includes a concrete mixture and polymer particles, a non-limiting example of which is disclosed in U.S. Patent Application Publication 2006/0225618 A1, the relevant disclosure of which is hereby incorporated by reference. In many instances the size, composition, structure, and physical properties of expanded polymer particles, and in some instances their resin bead precursors, can greatly affect the physical properties of LWC used in the invention. Of particular note is the relationship between bead size and expanded polymer particle density on the physical properties of the resulting LWC wall.

The polymer particles, which can optionally be expanded polymer particles, are present in the LWC composition at a level of at least 10, in some instances at least 15, in other instances at least 20, in particular situations up to 25, in some cases at least 30, and in other cases at least 35 volume percent and up to 90, in some cases up to 85, in other cases up to 78, in some instances up to 75, in other instance up to 65, in particular instances up to 60, in some cases up to 50, and in other cases up to 40 volume percent based on the total volume of the LWC composition. The amount of polymer particles will vary depending on the particular physical properties desired in a finished LWC wall. The amount of polymer particles in the LWC composition can be any value or can range between any of the values recited above.

The polymer particles in the lightweight concrete can include any particles derived from any suitable expandable thermoplastic material. The actual polymer particles are selected based on the particular physical properties desired in a finished LWC wall. As a non-limiting example, the polymer particles, which can optionally be expanded polymer particles, can include one or more polymers selected from homopolymers of vinyl aromatic monomers; copolymers of at least one vinyl aromatic monomer with one or more of divinyl-benzene, conjugated dienes, alkyl methacrylates, alkyl acrylates, acrylonitrile, and/or maleic anhydride; polyolefins; polycarbonates; polyesters; polyamides; natural rubbers; synthetic rubbers; and combinations thereof.

In an embodiment of the invention, the polymer particles in the lightweight concrete include thermoplastic homopolymers or copolymers selected from homopolymers derived from vinyl aromatic monomers including styrene, isopropylstyrene, alpha-methyl-styrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g. polyethylene, polypropylene), polycarbonates, polyphenylene oxides, and mixtures thereof.

In a particular embodiment of the invention, the polymer particles in the lightweight concrete are expandable polystyrene (EPS) particles. These particles can be in the form of beads, granules, or other particles.

In the present invention, particles polymerized in a suspension process, which are essentially spherical resin beads, are useful as polymer particles or for making expanded polymer particles for use in the lightweight concrete. However, polymers derived from solution and bulk polymerization techniques that are extruded and cut into particle sized resin bead sections can also be used.

In an embodiment of the invention, resin beads (unexpanded) to be used in the lightweight concrete containing any of the polymers or polymer compositions described herein have a particle size of at least 0.2 mm, in some situations at least 0.33 mm, in some cases at least 0.35 mm, in other cases at least 0.4 mm, in some instances at least 0.45 mm and in other instances at least 0.5 mm. Also, the resin beads can have a particle size of up to 3 mm, in some instances up to 2 mm, in other instances up to 2.5 mm, in some cases up to 2.25 mm, in other cases up to 2 mm, in some situations up to 1.5 mm and in other situations up to 1 mm. In this embodiment, the physical properties of LWC walls made according to the invention have inconsistent or undesirable physical properties when resin beads having particle sizes outside of the above described ranges are used to make the expanded polymer particles. The resin beads used in this embodiment can be any value or can range between any of the values recited above.

The expandable thermoplastic particles or resin beads used in the lightweight concrete can optionally be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g. CFC's and HCFC'S, which boil at a temperature below the softening point of the polymer chosen. Mixtures of these aliphatic hydrocarbon blowing agents can also be used.

Alternatively, water can be blended with these aliphatic hydrocarbons blowing agents or water can be used as the sole blowing agent as taught in U.S. Pat. Nos. 6,127,439; 6,160,027; and 6,242,540 in these patents, water-retaining agents are used. The weight percentage of water for use as the blowing agent can range from 1 to 20%. The texts of U.S. Pat. Nos. 6,127,439, 6,160,027 and 6,242,540 are incorporated herein by reference.

The impregnated polymer particles or resin beads used in the lightweight concrete are optionally expanded to a bulk density of at least 1.75 lb/ft$^3$ (0.028 g/cc), in some circumstances at least 2 lb/ft$^3$ (0.032 g/cc) in other circumstances at least 3 lb/ft$^3$ (0.048 g/cc) and in particular circumstances at least 3.25 lb/ft$^3$ (0.052 g/cc) or 3.5 lb/ft$^3$ (0.056 g/cc). When non-expanded resin beads are used higher bulk density beads can be used. As such, the bulk density can be as high as 40 lb/ft$^3$ (0.64 g/cc). In other situations, the polymer particles are at least partially expanded and the bulk density can be up to 35 lb/ft$^3$ (0.56 g/cc), in some cases up to 30 lb/ft$^3$ (0.48 g/cc), in other cases up to 25 lb/ft$^3$ (0.4 g/cc), in some instances up to 20 lb/ft$^3$ (0.32 g/cc), in other instances up to 15 lb/ft$^3$ (0.24 g/cc) and in certain circumstances up to 10 lb/ft$^3$ (0.16 g/cc). The bulk density of the polymer particles can be any value or range between any of the values recited above. The bulk density of the polymer particles, resin beads and/or pre-puff particles is determined by weighing a known volume of polymer particles, beads and/or pre-puff particles (aged 24 hours at ambient conditions).

The expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated polymer particles used in the lightweight concrete can be foamed cellular polymer particles as taught in U.S. Patent Application Publication No. 2002/0117769, the teachings of which are incorporated herein by reference. The foamed cellular particles can be polystyrene that are expanded and contain a volatile blowing agent at a level of less than 14 wt %, in some situations less than 8 wt %, in some cases ranging from about 2 wt % to about 7 wt %, and in other cases ranging from about 2.5 wt % to about 6.5 wt % based on the weight of the polymer.

An interpolymer of a polyolefin and in situ polymerized vinyl aromatic monomers that can be included in the expanded thermoplastic resin or polymer particles in the lightweight concrete according to the invention is disclosed in U.S. Pat. Nos. 4,303,756, 4,303,757, and 6,908,949, the relevant portions of which are herein incorporated by reference.

The polymer particles in the lightweight concrete can include customary ingredients and additives, such as flame retardants, pigments, dyes, colorants, plasticizers, mold release agents, stabilizers, ultraviolet light absorbers, mold prevention agents, antioxidants, rodenticides, insect repellants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In a particular embodiment of the invention the pigment is carbon black, a non-limiting example of such a material being EPS SILVER®, available from NOVA Chemicals Inc.

In another particular embodiment of the invention the pigment is graphite, a non-limiting example of such a material being NEOPOR®, available from BASF Aktiengesellschaft Corp., Ludwigshafen am Rhein, Germany.

When materials such as carbon black and/or graphite are included in the polymer particles, improved insulating properties, as exemplified by higher R values for materials containing carbon black or graphite (as determined using ASTM-C518), are provided. As such, the R value of the expanded polymer particles containing carbon black and/or graphite or materials made from such polymer particles are at least 5% higher than observed for particles or resulting walls that do not contain carbon black and/or graphite.

The expanded polymers in the lightweight concrete can have an average particle size of at least 0.2, in some circumstances at least 0.3, in other circumstances at least 0.5, in some cases at least 0.75, in other cases at least 0.9 and in some instances at least 1 mm and can be up to 8, in some circumstances up to 6, in other circumstances up to 5, in some cases up to 4, in other cases up to 3, and in some instances up to 2.5 mm. When the size of the expanded polymer particles is too small or too large, the physical properties of LWC walls made using the present LWC composition can be undesirable. The average particle size of the expanded polymer particles can be any value and can range between any of the values recited above. The average particle size of the expanded polymer particles can be determined using laser diffraction techniques or by screening according to mesh size using mechanical separation methods well known in the art.

In an embodiment of the invention, the polymer particles or expanded polymer particles used in the mold units and/or in the lightweight concrete have a minimum average cell wall thickness, which helps to provide desirable physical properties to LWC walls made using the present LWC composition. The average cell wall thickness and inner cellular dimensions can be determined using scanning electron microscopy techniques known in the art. The expanded polymer particles can have an average cell wall thickness of at least 0.15 μm, in some cases at least 0.2 μm and in other cases at least 0.25 μm. Not wishing to be bound to any particular theory, it is believed that a desirable average cell wall thickness results when resin beads having the above-described dimensions are expanded to the above-described densities.

In an embodiment of the invention, the polymer beads used in the mold units and/or in the lightweight concrete are optionally expanded to form expanded polymer particles such that a desirable cell wall thickness as described above is achieved. Though many variables can impact the wall thickness, it is desirable, in this embodiment, to limit the expansion of the polymer bead so as to achieve a desired wall thickness and resulting expanded polymer particle strength. Optimizing processing steps and blowing agents can expand the polymer beads to a minimum of 1.75 lb/ft$^3$ (0.028 g/cc). This property of the expanded polymer bulk density, can be described by pcf (lb/ft$^3$) or by an expansion factor (cc/g).

As used herein, the term "expansion factor" refers to the volume a given weight of expanded polymer bead occupies, typically expressed as cc/g.

In order to provide expanded polymer particles with desirable cell wall thickness and strength, the expanded polymer particles used in the mold units and/or in the lightweight concrete are not expanded to their maximum expansion factor; as such an extreme expansion yields particles with undesirably thin cell walls and insufficient strength. Further, the polymer beads can be expanded at least 5%, in some cases at least 10%, and in other cases at least 15% of their maximum expansion factor. However, so as not to cause the cell wall thickness to be too thin, the polymer beads are expanded up to 80%, in some cases up to 75%, in other cases up to 70%, in some instances up to 65%, in other instances up to 60%, in some circumstances up to 55%, and in other circumstances up to 50% of their maximum expansion factor. The polymer beads can be expanded to any degree indicated above or the expansion can range between any of the values recited above. Typically, the polymer beads or pre-puff beads do not further expand when formulated into the present concrete compositions and do not further expand while the concrete compositions set, cure and/or harden.

In embodiments of the invention, the pre-puff or expanded polymer particles used in the mold units and/or in the lightweight concrete typically have a cellular structure or honeycomb interior portion and a generally smooth continuous polymeric surface as an outer surface, i.e., a substantially continuous outer layer. The smooth continuous surface can be observed using scanning electron microscope (SEM) techniques at 1000× magnification. SEM observations do not indicate the presence of holes in the outer surface of the pre-puff or expanded polymer particles. Cutting sections of the pre-puff or expanded polymer particles and taking SEM observations reveals the generally honeycomb structure of the interior of the pre-puff or expanded polymer particles.

The polymer particles or expanded polymer particles used in the mold units and/or in the lightweight concrete can have any cross-sectional shape that allows for providing desirable physical properties in LWC walls. In an embodiment of the invention, the expanded polymer particles have a circular, oval or elliptical cross-section shape. In embodiments of the invention, the pre-puff or expanded polymer particles have an aspect ratio of 1, in some cases at least 1 and the aspect ratio can be up to 3, in some cases up to 2 and in other cases up to 1.5. The aspect ratio of the pre-puff or expanded polymer particles can be any value or range between any of the values recited above.

In particular embodiments of the invention, the lightweight concrete includes from 10 to 90 volume percent of a cement composition, from 10 to 90 volume percent of particles having an average particle diameter of from 0.2 mm to 8 mm, a bulk density of from 0.028 g/cc to 0.64 g/cc, an aspect ratio of from 1 to 3, and from 10 to 50 volume percent of sand and/or other fine aggregate, where the sum of components used does not exceed 100 volume percent.

Light-weight concrete compositions that are particularly useful in the present invention include those disclosed in co-pending U.S. application Ser. No. 11/387,198, the relevant portions of the disclosure are incorporated herein by reference.

When light-weight concrete is used in conjunction with the present wall forming system, the density of the mold units can be decreased further or, even greater concrete pour heights can be used at the same mold unit density.

The present invention has been described with reference to specific details of particular embodiments thereof. It is not intended that such details be regarded as limitations upon the scope of the invention except insofar as and to the extent that they are included in the accompanying claims.

We claim:

1. A concrete wall forming system comprising a plurality of interconnected mold units for forming a wall by receiving concrete therein, the units comprising a generally rectangular foamed plastic body having a first side, a second side oppositely opposed to the first side, a first end, a second end oppositely opposed to the first end, a top surface, and a bottom surface oppositely opposed to the top surface;

wherein the top surface comprises a bond beam form extending into the body lengthwise, defined by a first wall, a second wall, a bond beam form bottom, the first end of the foamed plastic body and the second end of the foamed plastic body, and where the first wall and second wall extend a depth defined by a portion of the distance from the top surface to the bottom surface, a first ledge extending lengthwise along the body from the first side to the first wall of the bond beam form, and a second ledge extending lengthwise along the body from the second side to the second wall of the bond beam form, wherein the bond beam form bottom extends from the first wall to the second wall of the bond beam form;

wherein the body comprises at least two column forms extending from the bond beam form bottom to the bottom surface;

wherein the body comprises form cuts extending the height of the foamed plastic body from the first side to the column forms;

wherein the foamed plastic body comprises an expanded polymer matrix;

wherein a finish surface is attached to at least the first side.

2. The concrete wall forming system according to claim 1, wherein the expanded polymer matrix comprises one or more polymers selected from the group consisting of homopolymers of vinyl aromatic monomers; copolymers of at least one vinyl aromatic monomer with one or more of divinylbenzene, conjugated dienes, alkyl methacrylates, alkyl acrylates, acrylonitrile, and/or maleic anhydride; polyolefins; polycarbonates; and combinations thereof.

3. The concrete wall forming system according to claim 1, wherein the polymer matrix comprises an interpolymer of a polyolefin and in situ polymerized vinyl aromatic monomers.

4. The concrete wall forming system according to claim 1, wherein the polymer matrix comprises carbon black, graphite or a combination thereof.

5. The concrete wall forming system according to claim 1, wherein the finish surface is selected from the group consisting of wood, rigid plastics, wood paneling, concrete panels, cement panels, drywall, sheetrock, particle board, rigid plastic panels, a metal lath, and combinations thereof.

6. The concrete wall forming system according to claim 1, wherein the bond beam form has a U-shaped, trapezoidal or rectangular cross-sectional shape.

7. The concrete wall forming system according to claim 1, wherein the column forms have a cross-sectional shape selected from the group consisting of round, oval, elliptical, square, rectangular, triangular, hexagonal and octagonal.

8. The concrete wall forming system according to claim 1, comprising a plurality of mold units and a plurality of corner units arranged sequentially from a first unit to a last unit such that the first end of the first unit is in contact with the second end of the last unit.

9. The concrete wall forming system according to claim 1, wherein the top surface has a length measured from the first end to the second end of from 6 to 30 feet and the first side has a height measured from the bottom surface to the top surface of from 16 inches to 24 feet.

10. The concrete wall forming system according to claim 1, wherein concrete reinforcing products are placed within the bond beam form and/or the column forms.

11. The concrete wall forming system according to claim 10, wherein the concrete reinforcing product comprises rebar.

12. A wall comprising the concrete wall forming system according to claim 1, wherein concrete is poured into and set in the bond beam form and column forms in the foamed plastic body.

13. A continuous wall comprising the concrete wall forming system according to claim 8, wherein concrete has been poured into and set in the bond beam forms and column forms in the mold units and corner units.

14. The wall according to claim 12, wherein the concrete comprises one or more cements selected from the group consisting of Portland cements, pozzolana cements, gypsum cements, aluminous cements, magnesia cements, silica cements, and slag cements.

15. The wall according to claim 12, wherein the concrete is light weight concrete.

16. The wall according to claim 15, wherein the light-weight concrete comprises from 10 to 90 volume percent of a cement composition, from 10 to 90 volume percent of particles having an average particle diameter of from 0.2 mm to 8 mm, a bulk density of from 0.028 g/cc to 0.64 g/cc, an aspect ratio of from 1 to 3, and from 10 to 50 volume percent of sand and/or other fine, wherein at least a portion of the sand and/or fine aggregate has a fineness modulus of less than 2; wherein the sum of components used does not exceed 100 volume percent.

17. The wall according to claim 12, wherein rebar is placed in the column forms and/or in the bond beam form prior to pouring concrete into the foamed plastic body.

* * * * *